US007220037B2

(12) United States Patent
Petre

(10) Patent No.: US 7,220,037 B2
(45) Date of Patent: May 22, 2007

(54) DETACHABLE DISPLAY HAVING AN ELECTRO-LUMINESCENT LIGHT SOURCE

(75) Inventor: Stephen J. Petre, White Plains, NY (US)

(73) Assignee: Lightsport Products, Inc., Santa Teresa, NM (US)

( * ) Notice: Subject to any disclaimer, the term of this patent is extended or adjusted under 35 U.S.C. 154(b) by 0 days.

(21) Appl. No.: 10/920,692

(22) Filed: Aug. 18, 2004

(65) Prior Publication Data

US 2005/0041414 A1 Feb. 24, 2005

Related U.S. Application Data

(60) Provisional application No. 60/497,006, filed on Aug. 20, 2003.

(51) Int. Cl.
*F21S 4/00* (2006.01)

(52) U.S. Cl. ..... 362/570; 362/84; 362/103; 362/105; 362/106; 362/108; 362/559; 40/544

(58) Field of Classification Search ..... 362/103, 362/108, 559, 570, 800, 105, 106, 84; 40/544
See application file for complete search history.

(56) References Cited

U.S. PATENT DOCUMENTS 5,113,325 A * 5/1992 Eisenbraun ..... 362/103
5,508,899 A * 4/1996 McCormick ..... 362/103
5,879,069 A * 3/1999 Chien ..... 362/103
6,443,590 B1 * 9/2002 Lovitt ..... 362/103
2001/0004808 A1 * 6/2001 Hurwitz ..... 36/137

* cited by examiner

*Primary Examiner*—Stephen F. Husar
*Assistant Examiner*—Meghan K. Dunwiddie
(74) *Attorney, Agent, or Firm*—Whitaker, Chalk, Swindle & Sawyer, LLP; Charles D. Gunter, Jr.; Stephen S. Mosher

(57) ABSTRACT

The present invention provides an article of clothing with a backlit display that emits light through a mask that allows signage to be placed on the garment. The garment has attached to its surface by clips or snaps a display module having a substantially flat envelope enclosing an electro-luminescent lamp and a mask. The electro-luminescent lamp layer is energized by an electrical signal from an control electronic circuit that passes its signal through the clips or snaps. The electro-luminescent layer may be divided into segments where each segment functions as an independent electro-luminescent layer receiving a potential having a pattern of illumination that is determined by the control electronic circuit. The invention can be used in safety apparel where the resulting pattern is a bright surface having the shape of a caution warning.

6 Claims, 1 Drawing Sheet

DETACHABLE DISPLAY HAVING AN ELECTRO-LUMINESCENT LIGHT SOURCE

CROSS REFERENCE TO RELATED APPLICATIONS

The present application claims priority from Provisional Application Ser. No. 60/497,006, filed Aug. 20, 2003, entitled "Detachable Display Having and Electro-Luminescent Light Source", by the same inventors.

BACKGROUND OF THE INVENTION

1. Field of the Invention

This invention is related to garments having optical displays on their surface. In particular it is related to such displays employing an electro-luminescent light source.

2. Description of the Prior Art

Garments are known that have designs on acetate layers illuminated by an electro-luminescent lamp. In addition, apparel having light emitting diode displays and implanted optical fiber displays have been disclosed. However in these prior technologies the displays have been combined with the garments requiring a permanent affixing of the display to the garment. Indeed, the complexity of the assembly of the display to the garment has required complex technologies for assembling fiber optic elements that were unsuited to making the display detachable from the garment. There is clearly an advantage to having the display detachable and readily reattachable from the basic garment. Such advantages relate to the ability to launder and reuse the garment, or to use the garment at times without the presence of the display.

SUMMARY OF THE INVENTION

In view of the aforesaid drawback of the conventional systems, it is an object of the present invention to provide a display system for use on a garment allowing the attachment and removal of display elements on the garment.

In one embodiment the invention comprises a garment having attached to a surface thereof a display module that comprises a substantially flat display envelope having a transparent front surface. Inside the envelope is an electro-luminescent lamp layer which is activated by electrical power connections from an inverter supplied with power from a battery. The display module is connected to the garment by snaps or other mechanical clips, which are also used as connectors for the electrical current activating the display. Thus the functions of mechanical and electrical connection are accomplished simultaneously.

To energize the electro-luminescent lamp layer an electrical signal is brought from a battery power source and an electrical inverter under the control of an control electronic circuit that determines when the layer emits light. A more complex arrangement has the electro-luminescent layer divided into segments where each segment functions as an independent electro-luminescent layer receiving a potential having a pattern of illumination that is determined by the control electronic circuit. In such a system the various segments of the display are nonetheless supplied with power through the connection clips. In order to separately energize the various display segments a multiplexing arrangement is made where the various elements receive power in a definite time sequence. This enables a single set of attachment points to provide electrical energy to a multiplicity of display elements.

The invention can be used in safety apparel where the resulting pattern is a bright surface having the shape of a caution warning. The present invention provides an article of clothing with a detachable backlit display that emits light that allows animation and special effects by design which can distinguish the user by the performance of an article of clothing.

DETAILED DESCRIPTION OF THE INVENTION

Figure 1:
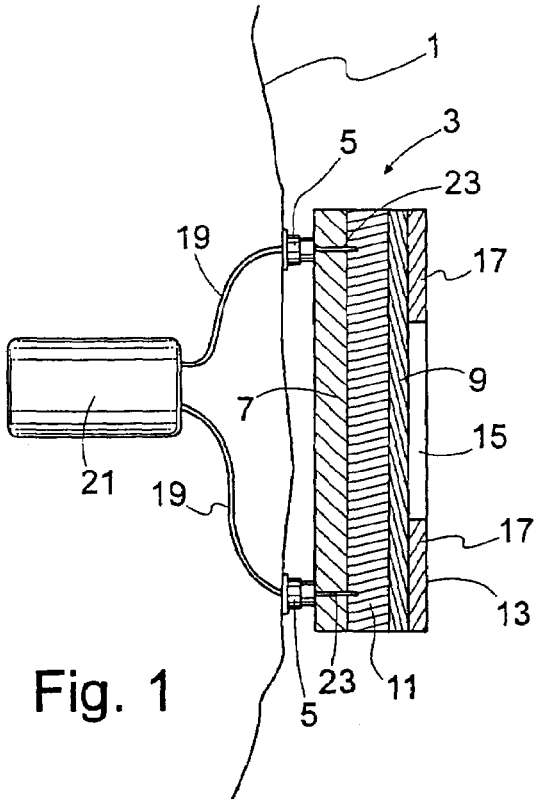
FIG. 1 depicts a cross section of a display module of the present invention.

As shown in FIG. 1, a garment 1 has attached to a surface thereof a display module 3. The module is attached by use of a removable attachment mechanism such as snaps, zippers or the like, provided that the attachment mechanism has an electrically conductive component. As shown in the figure, preferably snaps 5 connect the display module with the garment. The module 3 comprises an envelope having a transparent surface such as a substantially flat PVC envelope having a back surface 7 for attachment to the garment 1 and a transparent front surface 9. The transparency of the front surface 9 need not be total, but need only be sufficiently transparent to allow light from inside the envelope to escape through the front surface. In particular the front surface may contain elements that diffuse light, such as a lenticular screen so as to give a more uniform intensity. Inside the envelope is an electro-luminescent lamp layer 11 in contact with the back surface of the envelope. On the outside of the front surface 9 is a mask 13, having transparent sections 15 and opaque sections 17 as a result of which the illuminated front surface projects an image determined by the mask. Such an image could be a caution warning or other signage.

Figure 2:
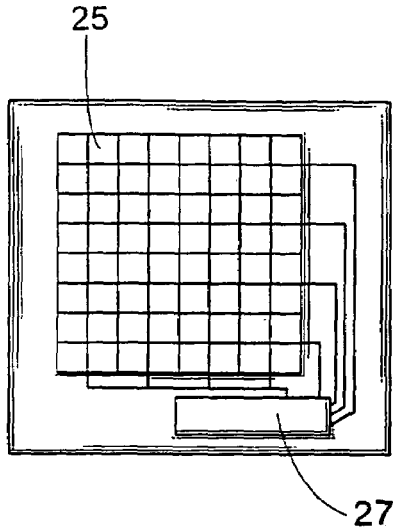
FIG. 2 depicts a electro-luminescent layer that is divided into independent segments.

To energize the electro-luminescent lamp layer 11 a signal is brought by a wiring harness 19 from a power pack 21 comprising a battery power source and an electrical inverter through the clips 5 through electrical connectors 23 to the electro-luminescent lamp 11. It is not essential that the clips themselves be conductors provided that they contain connectors that join the wire harness elements 19 to the conductors 23. The function of the inverter is to convert the direct current from the battery to an alternating current known to persons of skill in this art as sufficient to cause the electro-luminescent layer to emit light. The pack further comprises a control electronic circuit that determines when the layer 11 emits light. A simple control might only cause the layer 11 to flash periodically. A more complex arrangement could involve a electro-luminescent layer that is divided into segments. This is shown in FIG. 2, which depicts such a layer divided into segments 25. In effect each segment functions as an independent electro-luminescent layer receiving a potential from the inverter and having a pattern of illumination that is determined by the control electronic circuit. The segments 25, can be as small as desired in order to provide a display of any desired detail. In order for the signals from the wire harness to control multiple elements there could be implemented a multiplexing or strobing arrangement of the signals so that at specific times specific elements of the display are illuminated. To accomplish this a timing element 27 is placed in the display module which sends signals to the appropriate display elements in a timing sequence. This enable two wires 23 to control multiple elements. In the first preferred embodiment however the electro-luminescent layer is not subdivided and the display is accomplished by the mask 13 and its pattern of transparent 15 and opaque regions 17.

Figure 3:
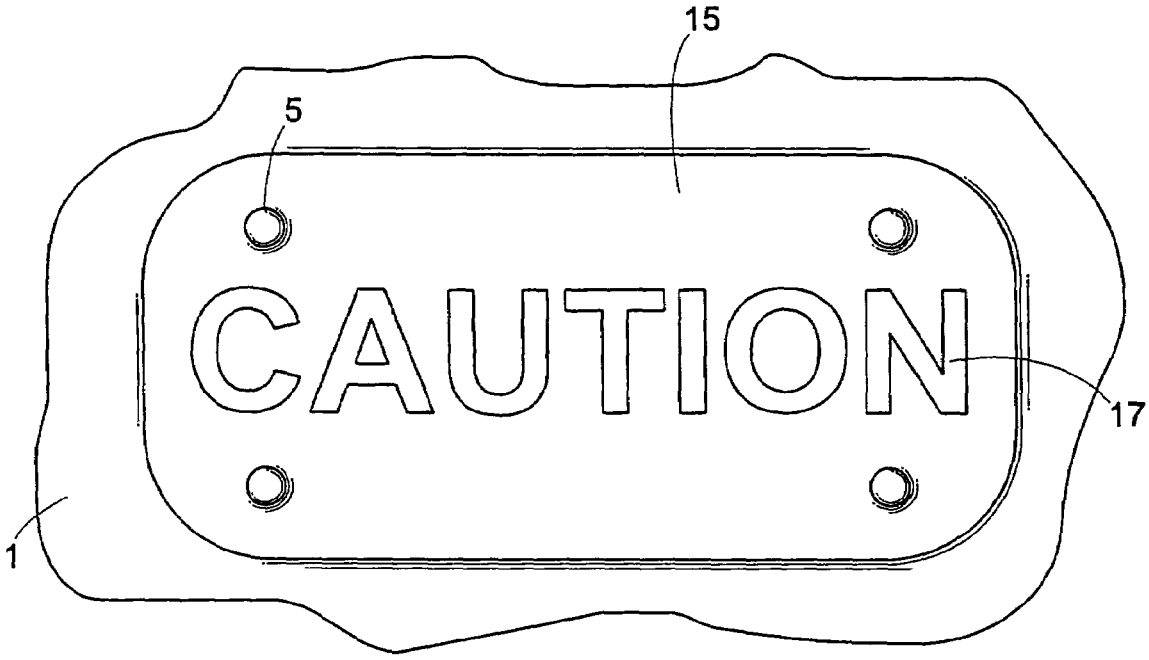
FIG. 3 depicts typical signage temporarily affixed to a garment.

FIG. 3 depicts typical signage applied to the surface of a garment.

In use, the garment has the display module attached to a surface thereof by clips. When turned on, electrical signals from the power pack 21 under control of the control electronic circuit, which may be nothing more than an array of switching circuits in conjunction with timing circuits arranged to produce a desired visible pattern, cause the elements of the electro-luminescent layer to emit light. The light from the electro-luminescent layer is patterned by the mask 13. This could be done for example in conjunction with safety apparel where the resulting pattern is a bright surface having the shape of a caution warning as shown in FIG. 3. This would enable the wearer to be safely identified even in darkness, rain, smoke and fog and in low light conditions where visibility is limited.

The present invention provides additional advantages. In particular it provides an article of clothing with a removable backlit display that emits light. The present invention allows animation and special effects by design which can distinguish the user by the performance of an article of clothing.

Although the invention has been discussed in terms of a particular embodiment sit will be understood by persons of skill in this art that it encompasses any use of its technology as described in the following claims.

What is claimed is:

1. An illumination display for safety apparel, comprising:

a detachable display module for use on a surface of the safety apparel, said module comprising:

an envelope having a back surface for attachment to the surface of the safety apparel and a light-transmitting front surface;

an electro-luminescent lamp layer having one or more segments capable of independent illumination and disposed inside the envelope and in contact with the back surface that emits light from each segment in response to a sequence of electrical driving signals;

a mask disposed on the outside of the front surface of the envelope and having transparent and opaque regions defining signage displaying an animated caution warning; and an electrical circuit including an inverter and a control circuit and receiving electrical power from a power pack, the electrical circuit providing the sequence of electrical driving signals to the electro-luminescent lamp layer in response to a timing sequence from a timing element in the control circuit; and electrically conductive snaps attached to the back surface of the envelope for both removably attaching the display module to the safety apparel and conducting the electrical power from the power pack to the electrical circuit in the display module.

2. The illumination display of claim 1, wherein the electro-luminescent lamp layer includes a plurality of segments that separately emit light in response to the sequence of electrical driving signals from the control circuit.

3. The illumination display of claim 1, wherein the electro-luminescent lamp layer flashes in response to the electrical driving signals from the control circuit.

4. The illumination display of claim 2, wherein the segments of the electro-luminescent lamp layer separately flash in response to the sequence of electrical driving signals from the control circuit.

5. The illumination display of claim 2, wherein the segments of the electro-luminescent lamp layer are separately illuminated in response to the sequence of electrical drive signals from the control circuit to create an animated image.

6. The illumination display of claim 1, wherein the control circuit in the electrical circuit comprises a multiplexing circuit for controlling multiple segments during the timing sequence of an animated caution warning.

* * * * *